US005944272A

United States Patent [19]

Comotto et al.

[11] Patent Number: 5,944,272

[45] Date of Patent: Aug. 31, 1999

[54] BOBBIN CORE HOLDER FOR A BOBBIN CREEL

[75] Inventors: Renato Comotto, Biella, Italy; Joachim Fritzson, Ulricehamn, Sweden

[73] Assignee: IRO AB, Ulricehamn, Sweden

[21] Appl. No.: 09/051,065

[22] PCT Filed: Oct. 9, 1996

[86] PCT No.: PCT/EP96/04380

§ 371 Date: Jun. 1, 1998

§ 102(e) Date: Jun. 1, 1998

[87] PCT Pub. No.: WO97/13715

PCT Pub. Date: Apr. 17, 1997

[30] Foreign Application Priority Data

Oct. 9, 1995 [DE] Germany ..... 195 37 571

[51] Int. Cl.[6] ..... B65H 49/02

[52] U.S. Cl. ..... 242/131; 242/130.4; 248/405; 248/406.1; 248/411; 248/413

[58] Field of Search ..... 242/131.1, 131, 242/130.4; 403/164; 248/405, 406.1, 411, 413

[56] References Cited

U.S. PATENT DOCUMENTS

| | | | |
|---|---|---|---|
| 1,886,638 | 11/1932 | Burton | 242/131.1 |
| 1,962,108 | 6/1934 | Cocker | 242/131.1 |
| 2,021,032 | 11/1935 | Swanson | 242/419.4 |
| 2,704,643 | 3/1955 | Lambach . | |
| 2,844,335 | 7/1958 | Freeze | 242/131.1 |
| 3,391,889 | 7/1968 | Stewart . | |
| 3,915,406 | 10/1975 | Rolli et al. | 242/131 |
| 4,234,138 | 11/1980 | Gehring et al. | 242/131.1 |
| 4,572,458 | 2/1986 | Bluhm et al. | 242/131 |
| 4,880,184 | 11/1989 | Crow | 242/130 |
| 5,271,684 | 12/1993 | Phillips | 403/106 |
| 5,323,982 | 6/1994 | Ligon et al. | 242/131 |
| 5,522,565 | 6/1996 | Deshaies | 242/575.2 |
| 5,624,082 | 4/1997 | Ligon | 242/131 |
| 5,810,271 | 9/1998 | Hamilton | 242/131.1 |

FOREIGN PATENT DOCUMENTS

| | | | |
|---|---|---|---|
| 516907 | 9/1955 | Canada | 242/131 |
| 0 429 173 A1 | 5/1991 | European Pat. Off. . | |
| 2708684 A3 | 2/1995 | France | 403/164 |
| 293 439 | 5/1929 | United Kingdom . | |
| 1 351 121 | 4/1974 | United Kingdom . | |
| 2113288 | 8/1983 | United Kingdom | 403/164 |

OTHER PUBLICATIONS

"Creels and Bobbin Core Holders" catalogue pages of ROJ–Electrotex, Italy (5 pages: head sheet, pp. 12, 13, and 15; page showing modular structure of an entire creel prior to assembly).

*Primary Examiner*—Donald P. Walsh
*Assistant Examiner*—Minh-Chau Pham
*Attorney, Agent, or Firm*—Flynn, Thiel, Boutell & Tanis, P.C.

[57] ABSTRACT

A bobbin core holder for a bobbin creel. The bobbin core holder includes a sleeve body securable on a creel rod, on which sleeve body a ring socket is fitted so as to be rotatable into at least one predeterminable rotary position by a releasable spring detent mechanism. The bobbin core holder also includes a bearing block on the ring socket having a bore therein for the bobbin core and an additional threaded bore opening into the bobbin core bore for a set screw. The bobbin core bore is open at both ends and is circumferentially closed with its axis extending transversely with respect to the axis of the ring socket. The bobbin core bore has an intermediate longitudinal section which at least partly extends through the ring socket, and the length of the bobbin core bore is approximately the same as the outside diameter of the ring socket. The threaded bore extends approximately radially relative to the ring socket axis.

13 Claims, 1 Drawing Sheet

BOBBIN CORE HOLDER FOR A BOBBIN CREEL

FIELD OF THE INVENTION

The invention relates to a bobbin core holder for a bobbin creel having a sleeve body securable on a creel rod, a ring socket rotatably supported on the sleeve body, and a bearing block provided on the ring socket having a recess for a bobbin core and a threaded bore for a fixing screw.

BACKGROUND OF THE INVENTION

In a bobbin core holder for vertical creel rods as known from a catalogue "Creels and Bobbin Holders" of ROJ-Electrotex, Italy, (p. I3, I5), the bearing block is not provided radially at the outer periphery of the ring socket. The recess is formed as a blind bore with a bore axis oriented approximately radially towards the axis of the holder. A fixing screw serves to secure the bobbin core when inserted into the recess. This fixing screw is inserted approximately tangentially in relation to the periphery of the ring socket. The bearing block of the known holder protrudes with a considerable extension. Only a relatively short support length for the bobbin core can be achieved. Furthermore, in some cases the bobbin core cannot be inserted far enough into the recess in order to secure a bobbin optimally. With heavy bobbins, locally concentrated loads may occur which leads to premature wearing of the recess, high stresses in the transition from the bearing block to the ring socket, and a vibrating bobbin. In order to change bobbins, the ring socket can be swivelled sidewardly against the holding action of a spring detent mechanism and in relation to the sleeve body. However, the holder allows only one position of the bobbin core, which position is determined by the position of the holder on the creel rod.

From the same catalogue, p. I2 and I5, however a bobbin core holder for horizontal creel rods is known, the recess bore of which is provided in a bearing block which projects sidewardly from the ring socket and is open at both ends, so that the bobbin core can be inserted into the recess bore from one side or the other. The ring socket is rotatable with little force in one direction starting from the working position assured on the fixed holder by the weight of the bobbin (bobbin change). In order to position the bobbin core at the other side of the creel rod, it is necessary to completely release the holder on its creel rod and to rotate it. Furthermore, it is disadvantageous that the bobbin core is held between two clamping flanges by means of two clamping screws. This necessitates cumbersome and time consuming manipulations for securing and releasing the bobbin core and leads to deformations of the clamping flanges thus reducing the useful life thereof. Finally, the sideward distance of the bobbin core from the creel rod is relatively large so that with heavy bobbins, large loads and eccentrical forces occur which deteriorate the holding effect of the holder on the creel rod and produce wear in the material of the holder. The relatively large distance between the bobbin core and the axis of the creel rod cannot prevent vibrations of the bobbin.

It is an object of the invention to create a bobbin core holder which may be utilized with both horizontal and vertical creel rods, and which allows a rapid sidewards pivoting of the bobbin for a bobbin change without need for releasing fastening means. The bobbin core holder in accordance with the invention has compact dimensions and which permits stable and space saving support of the bobbin core. The holder should allow positioning of a bobbin core without cumbersome manipulations either at one side or the other of a creel rod in order to easily cope with restricted mounting space relationships or to provide an optimal yarn withdrawal geometry.

The above object can be achieved by providing the bearing block with a circumferentially closed bore which is open at both ends and has a bore axis oriented laterally relative to the axis of the ring socket. Further, the bore of the bearing block has an intermediate longitudinal section which partially penetrates the ring socket.

The holder is compact, comfortable to manipulate and provides a particularly stable and space saving support for the bobbin core at each creel rod. The bore utilizes space within the "material" of the ring socket and therefore is optimally located close to the creel rod. The bearing block projects outwardly only a small amount. The bobbin core is supported close to the creel rod. The holder is useful for both vertical and horizontal creel rods. The short lever arm of the long bore in relation to the axis of the ring socket not only saves space, but also provides stable support to the mass of the bobbin in case of or against vibrations.

The bore is extremely long with its end sections leaving the ring socket in the bearing block. In this regard, the longitudinal extension of the bore approximately equals the outer diameter of the ring socket. In addition, a threaded bore is oriented generally radially relative to the ring socket axis for receiving a fixing or set screw. As a consequence, significant support length can be achieved for the bobbin core. The bore, being open at both ends, allows the insertion of the bobbin core or the foot part of the bobbin core, respectively, as far as is necessary and suitable for optimum and stable support of the bobbin. Occasionally, the free end of the bobbin core even can project beyond the other bore end. The bobbin core can be introduced into each end of the bore so that the ring socket can be rotated by 180° in order to support the bobbin core at the other side of the creel rod, in case that space restrictions or the yarn geometry could make this necessary. The fixing screw is comfortable to manipulate since it is easily accessible. The rotatability of the ring socket and the spring detent mechanism have a double function since they allow comfortable handling in case of a bobbin exchange as only the ring socket has to be rotated sufficiently far from its working position, and further allow rotation of the ring socket by 180° in order to position the bobbin core at the other side of the creel rod.

The embodiment wherein the threaded bore is provided within a projection of the bearing block is advantageous since the projection of the bearing block assures sufficient material for the fixing screw in its threaded bore without significantly enlarging the compact dimensions of the holder.

In accordance with one embodiment, the threaded bore is embodied by a threaded insert. This embodiment is advantageous since even after an extended period of use wearing of the thread will not occur.

The embodiment wherein the spring detent mechanism is engageable in two rotational positions of the ring socket leads to the advantage that the ring socket has two diametrically opposite and stable rotational positions in which the bobbin core is firmly supported. As a consequence, the bobbin core can be displaced from one side of a creel rod to the other side thereof without releasing the holding action, e.g. in case that the space restriction or the yarn geometry should make this necessary.

An advantageous embodiment which is easy to manufacture and to assemble includes a sleeve body having a pair of detent recesses each for positioning a roller body, and a C-shaped, pre-loaded spring which applies pressure to the roller bodies from the outside. The spring detent mechanism can easily be integrated within the compact dimensions of the ring socket and the sleeve body. With a C-shaped spring, strong holding forces for stable rotational positions of the ring socket can be achieved as soon as the roller bodies engage within the detent recesses.

A particularly stabilized fixing of the holder at its creel rod is possible with the embodiment wherein the sleeve body projects axially beyond both ends of the ring socket and carries annular caps thereon. Furthermore, the caps and the fixation of the caps and of the sleeve body at the creel rod is practical in terms of manufacturing and assembly.

The embodiment wherein the bore and the bearing block are oriented generally perpendicular to the axial direction of the holder serves to secure a bobbin core vertically in relation to the axis of the creel rod.

The embodiments wherein the ring socket and sleeve body are formed of fiber-reinforced plastic material and wherein the caps are formed of metal are advantageous in terms of easy manufacturing and long life duration and low weight.

BRIEF DESCRIPTION OF THE DRAWINGS

Embodiments of the invention will be described with reference to the drawings, in which.

DETAILED DESCRIPTION

Figure 1:
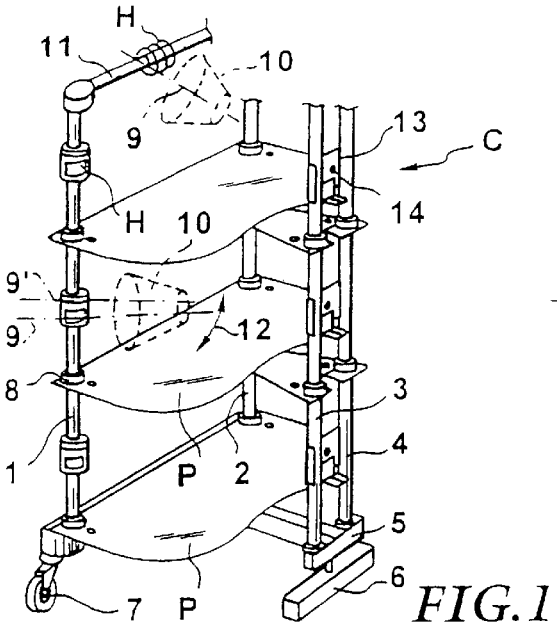
FIG. 1 is a schematic perspective view of part of a bobbin creel having holders for bobbin cores or bobbins at vertical and/or horizontal creel rods.

A bobbin creel C in FIG. 1, e.g. used on weaving looms equipped with yarn feeding devices in order to support sometimes voluminous and heavy yarn bobbins, is provided e.g. with four vertical creel rods 1,2,3,4 which are connected with another via a foot part 5 having a foot 6 and ground wheels 7. In case that only vertical creel rods are provided, optionally a head part is (not shown) integrated into the creel in order to stiffen the creel. It is, however, possible to provide horizontal creel rods, e.g. such as the creek rod 11. The horizontal creel rods stiffen the creel and also allow the securing of bobbins thereon. The bobbin creel C can be divided into several stories by means of horizontal separating plates P removably secured to separating plate-holders 8 of the creel rods. Normally, a bobbin creel (FIG. 1, lower part) is provided with vertical creel rods only, at which the provided bobbins are held, and with stories located one above the other. Alternatively a bobbin creel may be provided with horizontal creel rods only (as in FIG. 1, upper part) for fixing all bobbins and with horizontally arranged compartments separated from another by hanging separation plates. The creel rods for supporting the bobbins of course are respectively interconnected with further creel rods (not shown) to define a self-standing substrate in which the further creel rods do not support any bobbins. However, also a hybrid creel design as shown in FIG. 1 including horizontal and vertical creel rods commonly defining the creel and both serving for supporting bobbins may be practicable.

In order to hold the bobbins 10 by means of their bobbin cores 9, bobbin core holders H are fixed on the creel rods. These holders H can be seen in detail in FIGS. 2 and 3. Creel rods 3 and 4 in this case are connected with one another by means of inserts 13 in which outlet eyelets 14 for the respective yarn can be provided.

For bobbin 10 shown in FIG. 1 (middle part) the holder H is secured such that the axis of the bobbin 10 or its bobbin core 9 is pointing approximately towards the associated outlet eyelet. The holder H has (FIGS. 2 and 3) a ring socket (FIG. 2) 19 which can be rotated by 180° in order to position the bobbin core 9' at one or the other side of creel rod 1, e.g. because of restricted space and/or in view to a desirable yarn outlet geometry. Furthermore, the bobbin core 9 can be voluntarily swivelled with said ring socket in the directions indicated by the double arrow 12 far back and forth in case of a bobbin exchange. After a bobbin exchange, the new bobbin is swivelled back together with its bobbin core into the respective fixed working position.

Figure 2:
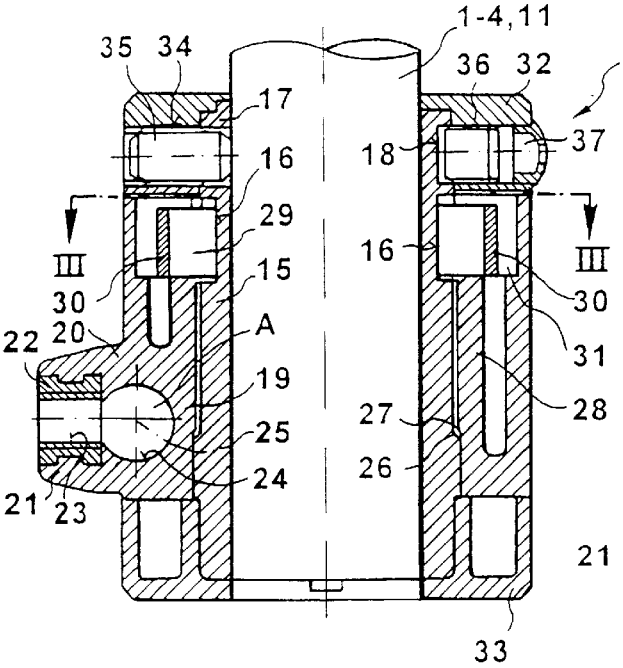
FIG. 2 is a longitudinal section of a holder which can be used in the bobbin creel illustrated in FIG. 1.
Figure 3:
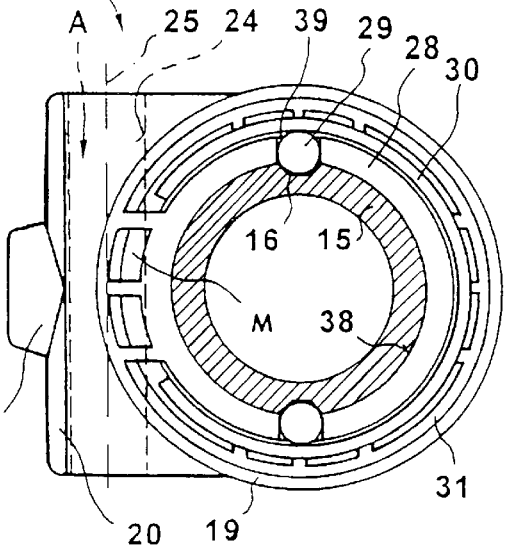
FIG. 3 is a section through the holder of FIG. 2 in the section plane III—III.

In FIGS. 2 and 3, the holder H is provided with an inner sleeve body 15 which is secured on one of the creel rods 1–4, 11, e.g. with the help of a fixing screw 35. In an axially restricted longitudinal range of sleeve body 15, two diametrically opposed detent recesses 16 are provided, which recesses 16 are formed in the outer periphery thereof. At least an end of the sleeve body 15 contains a radial bore 17 (optionally a threaded bore) for a fixing screw 35. At a location offset in circumferential direction in relation to said bore 17 a recess 18 is formed.

Figure 4:
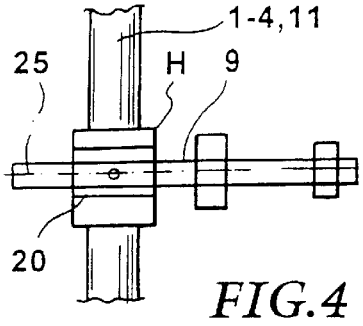
FIG. 4 is a schematic side view of a holder with an inserted bobbin core.

On the sleeve body 15 a concentrical ring socket 19 is rotatably provided which carries a unitary or integrally formed bearing block 20 extending cross-wise in relation to the axis of the ring socket 19. The bearing block 20 has a projection 21 projecting outwardly approximately in the middle section of ring socket 19. Inside projection 21 and bearing block 20, a threaded insert 22 is embedded which contains a threaded bore 23 for a fixing or set screw (not shown). The threaded bore 23 opens into a recess A for a bobbin core 9. The recess A is a circumferentially closed through bore 24 formed in bearing block 20, both ends of which bore 24 are open. The bore 24 contains a mid-longitudinal section M with the form of a circle segment which is located in the interior of ring socket 19. Accordingly, the axis 25 of bore 24 is situated close to sleeve body 15 or the creel rod respectively. The bore axis 25 extends together with the bearing block 20 perpendicularly to the axis of the creel rod as shown in FIG. 4.

The sleeve body 15 has a peripheral shoulder 26 cooperating with an inner shoulder 27 of ring socket 19 in order to secure the latter axially. The ring socket 19 is pushed onto the sleeve body 15 from above (FIG. 2).

The ring socket 19 is provided inside with pocket-shaped cavities and stiffening ribs so that an internal skirt 28 is formed which extends beyond the location of the detent recesses 16 in sleeve body 15. In these detent recesses 16 (in the holding position or the fixed rotational position of ring socket 19, respectively) two roller bodies 29 are situated, which roller bodies 29 take the form of a ball or a barrel, for example. Each roller body 29 projects from its detent recess 16 outwardly and engages into a circumferential recess 39 of skirt 28. A pre-loaded C-shaped spring 30 bears on the outer sides of same in order to retain same in their detent recesses 16. Outside of spring 30 in ring socket 19 is provided a radial expansion space 31, the radial width of which is determined such that spring 30 is able to yield as soon as said roller bodies 29 begin to completely leave their detent recesses 16.

At both ends of the sleeve body 15, projecting beyond the ring socket 19, caps 32, 33 of annular shape are secured, either by pressing or are secured by means of safety bolts 37 against rotation and removal. In cap 32 a radial bore 36 can be seen into which safety bolt 37 is inserted and secured, e.g., by gluing, so that the inner end of bolt 37 engages within recess 18. Furthermore, in cap 32 a threaded bore 34 for fixing screw 35 is provided. Fixing screw 35 can be pressed against the circumference of the respective creel rod 1–4, 11 in order to fix the position of the sleeve body 15 on the creel rod. Between the detent recesses 16 on the sleeve body 15 support surfaces 38 are formed for the roller bodies 29.

When the roller bodies 29 according to FIGS. 2 and 3 are pressed into their detent recesses 16, the ring socket 19 is fixed in a predetermined rotational position on sleeve body 15. The bobbin core 9 is inserted as far into bore 24 as is necessary for an optimal positioning of the bobbin and is fixed by means of a fixing screw screwed into threaded bore 23. For a bobbin exchange, the ring socket 19 is rotated by means of the bobbin core in relation to sleeve body 15. In this case, the roller bodies 29 are lifted, by means of oblique ramps of the detent recesses 16, out of the respective detent recesses 16, and are displaced by the circumferential recesses 39 in skirt 28 of the ring socket 19 along support surfaces 38 in the respective rotational direction. In the meantime, the spring 30 is expanding into expansion space 31. The friction of the roller bodies 29 on support surfaces 38 under the force of spring 30 suffices to position the rotated ring socket 19 in any intermediate position in case of a bobbin exchange. As soon as a new bobbin is put on, the ring socket 19 is rotated back in its home position by means of the bobbin core until the roller bodies 29 again fall into their respective detent recesses 16. Should it become necessary to displace the bobbin core to the other side of the creel rod, then the ring socket 19 is rotated by 180° until the roller bodies 29 again fall into their detent recesses. The bobbin core then is inserted into bore 24 from the other end of the bore and is fixed therein. Although a particular preferred embodiment of the invention has been disclosed in detail for illustrative purposes, it will be recognized that variations or modifications of the disclosed apparatus, including the rearrangement of parts, lie within the scope of the present invention.

We claim:

1. Bobbin core holder for a bobbin creel, having a sleeve body securable on a creel rod, a ring socket rotatably supported on the outer side of said sleeve body which ring socket is securable in at least one predetermined rotational position via a releasable spring detent mechanism, a bearing block provided on said ring socket, which bearing block has a bore for receiving a bobbin core and a threaded bore opening into said bobbin core bore for receiving a set screw, comprising the improvement wherein said bobbin core bore is a circumferentially closed bore provided in said bearing block, said bobbin core bore being open at both ends and having a longitudinal bore axis arranged laterally in relation to an axis of said ring socket, said bobbin core bore having an intermediate longitudinal section extending at least partially within said ring socket.

2. Bobbin core holder as in claim 1, wherein the longitudinal extension of said bobbin core bore approximately equals an outer diameter of said ring socket, and said threaded bore is oriented generally radially with respect to the axis of said ring socket.

3. Bobbin core holder as in claim 2, wherein said threaded bore is provided within a projection of said bearing block.

4. Bobbin core holder as in claim 2, wherein said threaded bore is defined by a threaded insert embedded in said bearing block such that said threaded insert cannot be rotated or pulled out of said bearing block.

5. Bobbin core holder as in claim 1, wherein said spring detent mechanism permits movement of said ring socket into two rotational positions offset approximately 180° from one another.

6. Bobbin core holder as in claim 1, wherein said sleeve body is provided with two diametrically opposite, outwardly opening, and essentially V-shaped detent recesses each for positioning a roller body therein and with circumferentially extending roller body support surfaces interconnecting said detent recesses, said roller bodies upon being seated in their respective detent recesses project beyond said detent recesses and outwardly into circumferential recesses formed in said ring socket, a C-shaped, preloaded spring applies pressure to said roller bodies from the outside and extends in the circumferential direction, and within said ring socket a radial spring expansion space is defined outwardly of said spring.

7. Bobbin core holder as in claim 1, wherein said sleeve body projects axially beyond both ends of said ring socket and carries annular caps thereon which are axially and non-rotatably secured with at least one safety bolt to said sleeve body, and at least one of the caps defines therein a radially extending threaded bore for receiving at least one set screw, which set screw can be screwed into a radially extending bore defined in said sleeve body inwardly of said threaded bore of said one cap and aligned therewith.

8. Bobbin core holder as in claim 1, wherein said bobbin core bore and said bearing block are oriented generally perpendicularly with respect to an axial direction of said holder.

9. Bobbin core holder as in claim 1, wherein said ring socket and said sleeve body are formed of fiber-reinforced plastic material.

10. Bobbin core holder as in claim 7, wherein said caps are formed of zinc by pressure casting.

11. Bobbin core holder as in claim 1 wherein said bearing block is formed integrally with said ring socket and projects sidewardly therefrom.

12. Bobbin core holder as in claim 1 wherein said axis of said bobbin core bore and said axis of said ring socket define skew lines.

13. Bobbin core holder as in claim 1 wherein said axis of said bobbin core bore lies closely adjacent said sleeve body such that the distance between the bobbin core and the creel rod is minimized to provide stable support to the bobbin core.

* * * * *